US005084930A

United States Patent [19]

Danova

[11] Patent Number: 5,084,930

[45] Date of Patent: Feb. 4, 1992

[54] COMBINED SOFT SCULPTURE AND BLANKET

[75] Inventor: Cesare M. Danova, Los Angeles, Calif.

[73] Assignee: BHT Holdings Limited, Hong Kong

[21] Appl. No.: 104,927

[22] Filed: Oct. 6, 1987

Related U.S. Application Data

[63] Continuation-in-part of Ser. No. 935,339, Nov. 26, 1986, Pat. No. 4,734,948.

[51] Int. Cl.[5] ..... A47G 9/02

[52] U.S. Cl. ..... 5/502; 5/482; 446/73; 446/76; D6/598

[58] Field of Search ..... 5/502, 413, 500, 482, 5/420, 485; 2/69.5; 446/71-74, 76, 369; D6/598, 599, 603

[56] References Cited

U.S. PATENT DOCUMENTS

| | | | |
|---|---|---|---|
| D. 174,238 | 3/1955 | Stevens | D92/2 |
| D. 217,368 | 4/1970 | Klamer | D34/2 |
| D. 226,101 | 1/1973 | Marcus | 34/4 R |
| D. 256,202 | 8/1980 | Schmickel et al. | D6/203 |
| D. 273,028 | 3/1984 | Finney | D21/190 |
| 820,027 | 5/1906 | Tabor . | |
| 1,026,460 | 5/1912 | Rusk . | |
| 1,396,766 | 11/1921 | McClelland . | |
| 1,437,467 | 12/1922 | Dykman . | |
| 1,575,263 | 3/1926 | Guglielmi . | |
| 2,183,418 | 12/1939 | Williams . | |
| 2,195,127 | 3/1940 | Brucker | 46/153 |
| 2,274,303 | 2/1942 | Ornstein | 46/153 |
| 2,315,126 | 3/1943 | Michalke | 190/43 |
| 2,325,750 | 8/1943 | De Vries | 46/153 |
| 2,655,762 | 10/1953 | Burke | 46/116 |
| 2,678,505 | 5/1954 | Munson | 35/17 |
| 2,791,775 | 5/1957 | Sartell | 2/69.5 |
| 2,852,885 | 1/1957 | Mayer | 46/154 |
| 2,971,205 | 2/1961 | Schultz . | |
| 3,082,437 | 3/1963 | Upthagrove . | |
| 3,176,315 | 4/1965 | Freund | 2/69 |
| 3,226,849 | 1/1966 | Rosen | 36/1 |
| 3,447,165 | 6/1969 | Brosk | 2/75 |
| 3,477,552 | 11/1969 | Goldman | 190/2 |
| 3,774,249 | 11/1973 | Ybarra et al. . | |
| 3,789,546 | 2/1974 | Morrison | 46/116 |
| 3,820,276 | 6/1974 | Goldfarb et al. | 46/154 |
| 3,831,316 | 8/1974 | Weistrop | 46/153 |
| 3,851,419 | 12/1974 | Kaelin | 46/153 |
| 3,864,871 | 2/1975 | Kaelin | 46/153 |
| 3,955,309 | 5/1976 | Noble | 46/151 |
| 4,062,076 | 12/1977 | Albertson . | |

(List continued on next page.)

OTHER PUBLICATIONS

"Pillow Fight?", an advertisement for DREAM PALS, The Bibb Co., appearing on p. 11 of *Home Furnishings Weekly*, Jun. 29, 1987.

*Primary Examiner*—Alexander Grosz

*Attorney, Agent, or Firm*—Cushman, Darby & Cushman

[57] ABSTRACT

A soft-sculptural creature is provided with a torso having a front panel and a back panel respectively having upper edges joined to the front and rear of the perimeter of a neck, opening into a hollow head. The front half of the head is stuffed and has a face. Stuffed arms and legs are attached at respective ends to the front panel. The soft-scuptural creature is sandwiched onto a marginal portion of a blanket at a location offset to one side of the top edge of the blanket and the front panel is sown around at least part of its perimeter to the blanket. The blanket can be removably stuffed into the soft-sculptural creature by rolling, folding or similarly condensing the blanket, stuffing some of it into the back half of the head through the neck opening, removably joining corresponding parts of the left margins of the front and rear panels to one another, corresponding parts of the right margins of the front and rear panels to one another, and wrapping rearwardly a flap provided on the front panel and removably joining it to the lower margin of the back panel. When the blanket is opened out and in use, the back panel can be stuffed into the back half of the head, and a person covered by the blanket can lie with an arm curled around the neck of the soft-sculptural creature.

42 Claims, 3 Drawing Sheets

U.S. PATENT DOCUMENTS

| | | | |
|---|---|---|---|
| 4,091,481 | 5/1978 | Redman . | |
| 4,174,059 | 11/1979 | Maunder | 224/209 |
| 4,236,263 | 12/1980 | Allee | 5/413 |
| 4,288,222 | 9/1981 | Kling | 434/272 |
| 4,304,065 | 12/1981 | Baiera | 46/154 |
| 4,316,287 | 2/1982 | Rule | 2/69.5 |
| 4,336,665 | 6/1982 | Moreau | 46/153 |
| 4,372,077 | 2/1983 | Balbuena | 46/116 |
| 4,413,442 | 11/1983 | McSweeney | 46/151 |
| 4,458,372 | 7/1984 | Mills | 5/418 |
| 4,505,687 | 3/1985 | Munro | 446/368 |
| 4,543,669 | 10/1985 | Katz | 2/84 |
| 4,563,159 | 1/1986 | Hills et al. | 446/74 |
| 4,590,633 | 5/1986 | Pickens | 5/482 |
| 4,614,505 | 9/1986 | Schneider et al. | 446/372 |
| 4,739,529 | 4/1988 | Mills | 5/413 |
| 4,750,225 | 6/1988 | Simmons et al. | 5/485 |
| 4,754,512 | 7/1988 | Chao-Yang | 5/482 |
| 4,774,734 | 10/1988 | Mills | 5/413 |

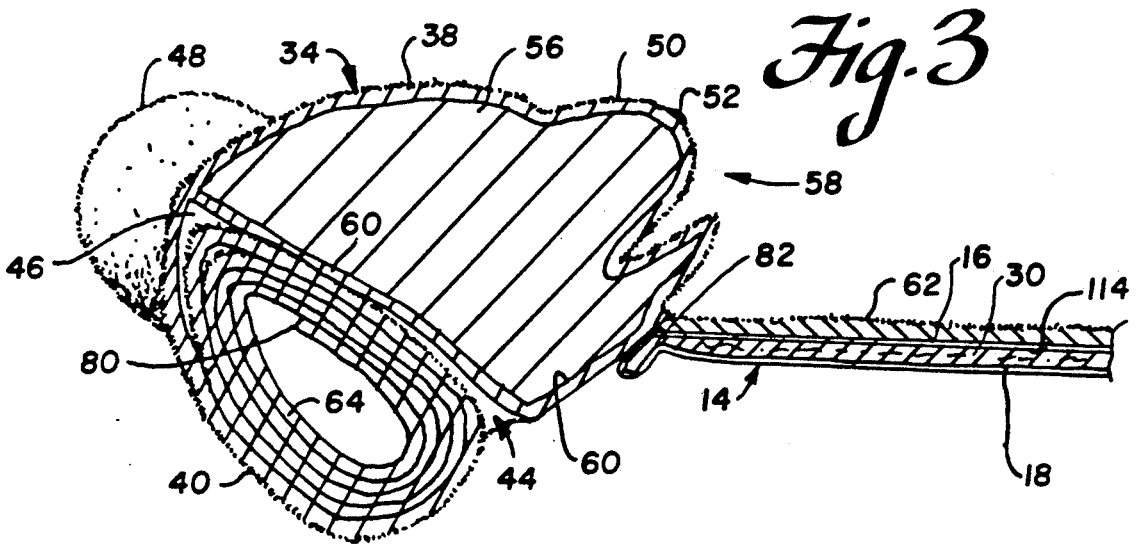
Fig. 3
Fig. 4
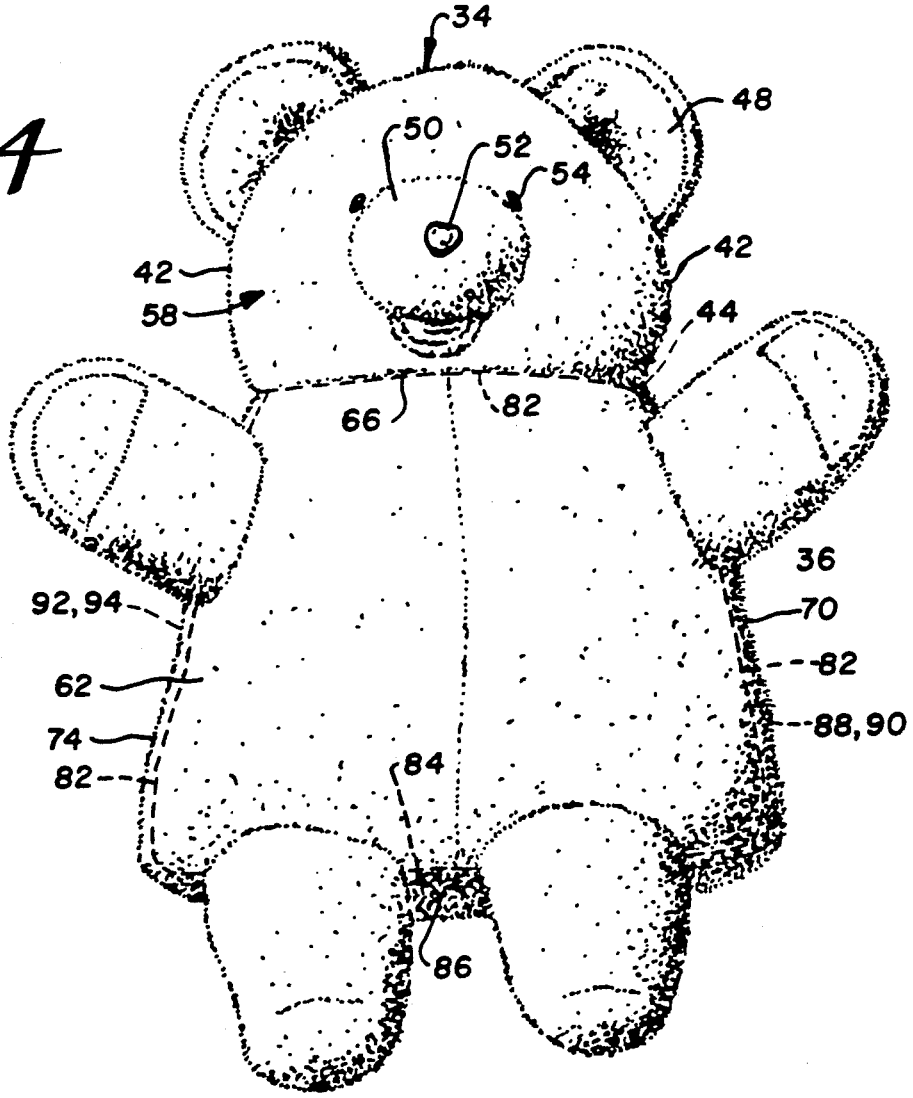

COMBINED SOFT SCULPTURE AND BLANKET

REFERENCE TO RELATED APPLICATION

This is a continuation-in-part of my copending application Ser. No. 935,339, filed Nov. 26, 1986, now U.S. Pat. No. 4,734,948.

BACKGROUND OF THE INVENTION

In my aforementioned earlier application, I have disclosed a convertible figure i.e. an article which is convertible between a first configuration in which it appears to be, and is functionable as a soft-sculptural toy in the nature of a stuffed animal, doll, fantastic creature or the like, and a second configuration in which a blanket, which was rolled and/or folded into a closed cavity within the body of the creature, remains attached to the body, but lies outside the cavity so that it can be spread and used as a covering, while the resultingly de-stuffed remainder of the soft-sculptural creature remains visible as an applique on the outside of the blanket.

The present invention provides an improvement upon the convertible figure of the aforementioned earlier application.

SUMMARY OF THE INVENTION

A soft-sculptural creature is provided with a torso having a front panel and a back panel respectively having upper edges joined to the front and rear of the perimeter of a neck, opening into a hollow head. The front half of the head is stuffed and has a face. Stuffed arms and legs are attached at respective ends to the front panel. The soft-sculptural creature is sandwiched onto a marginal portion of a blanket at a location offset to one side of the top edge of the blanket and the front panel is sown around at least part of its perimeter to the blanket. The blanket can be removably stuffed into the soft-sculptural creature by rolling, folding or similarly condensing the blanket, stuffing some of it into the back half of the head through the neck opening, removably joining corresponding parts of the left margins of the front and rear panels to one another, corresponding parts of the right margins of the front and rear panels to one another, and wrapping rearwardly a flap provided on the front panel and removably joining it to the lower margin of the back panel. When the blanket is opened out and in use, the back panel can be stuffed into the back half of the head, and a person covered by the blanket can lie with an arm curled around the neck of the soft-sculptural creature.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 3 is a fragmentary longitudinal sectional view thereof taken on the medial line of the soft-sculptural creature and showing the rear panel of the torso stored in the back half of the head.

FIG. 4 is a front elevational view of the soft-sculptural creature, with the blanket completely stowed inside its body cavity as a stuffing thereof.

DETAILED DESCRIPTION

Figure 1:
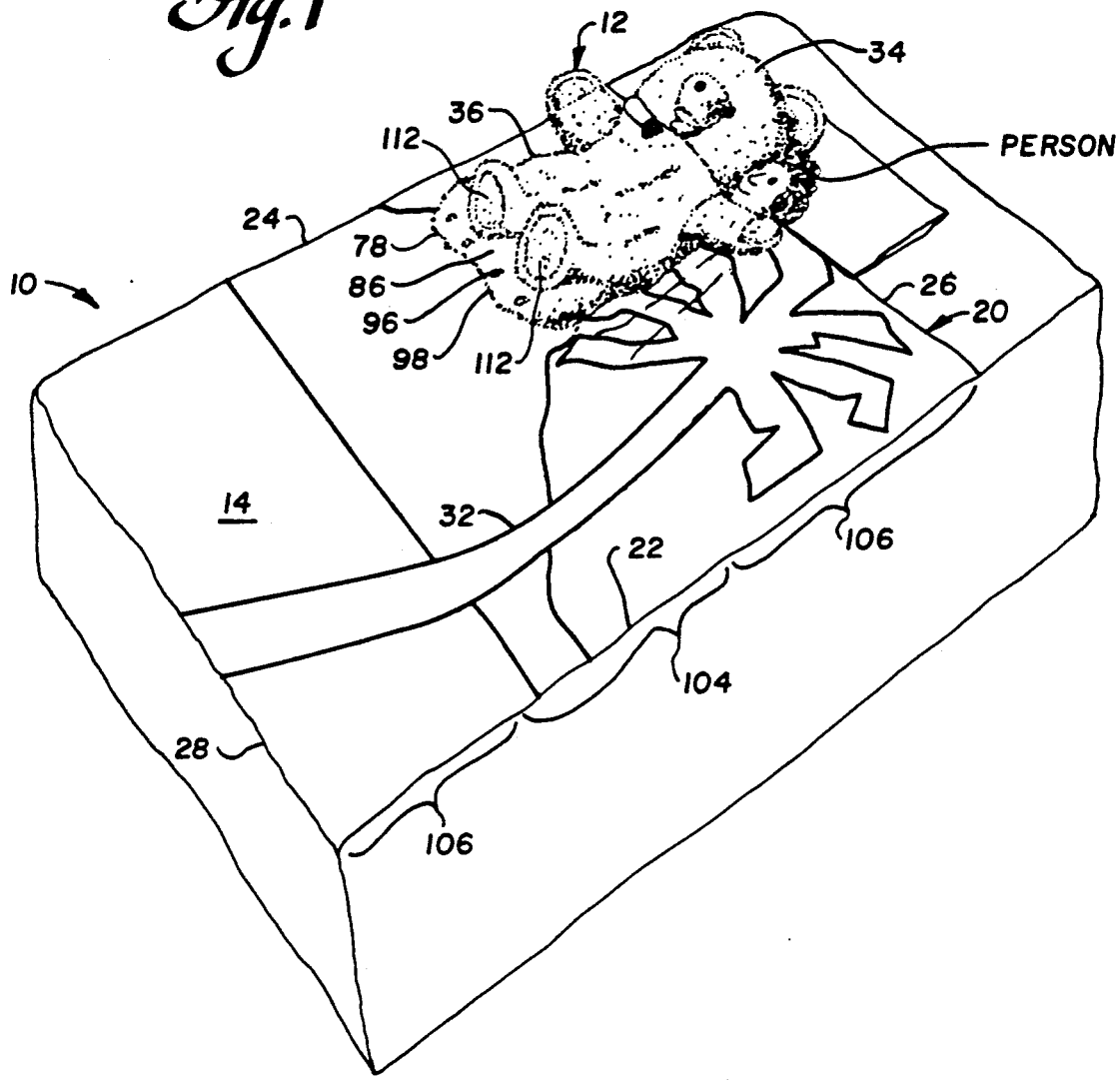
FIG. 1 is a perspective view from above, of a person asleep under the blanket while cuddling the soft-sculptural creature, both of the combined soft sculpture and blanket of the present invention.
Figure 2:
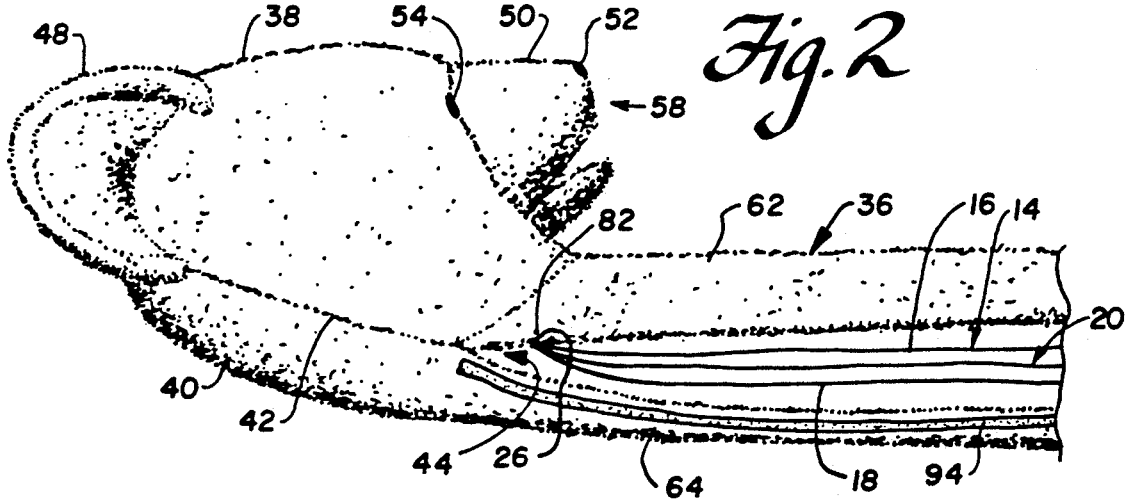
FIG. 2 is a fragmentary exploded side view of a combined soft sculpture and blanket embodying principles of the present invention.
Figure 5:
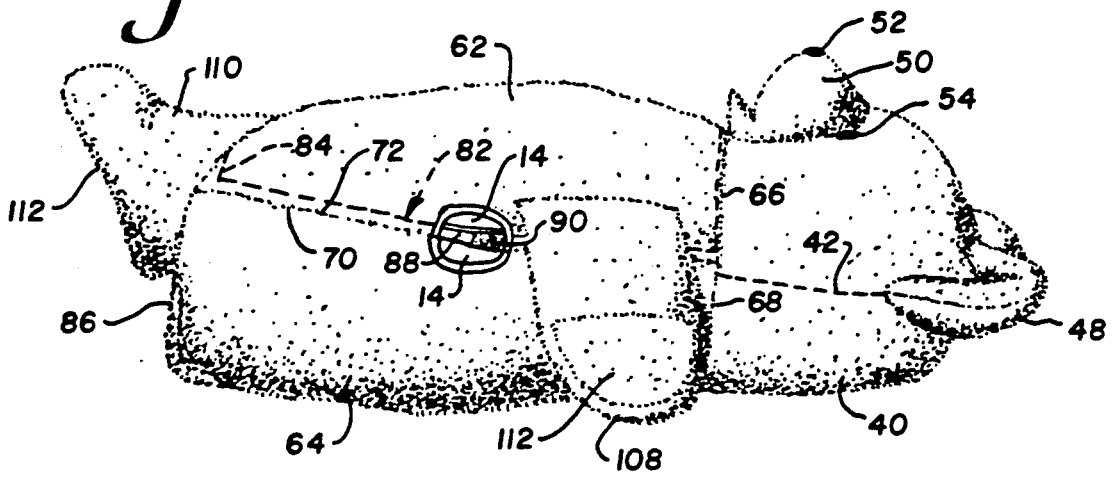
FIG. 5 is a left side elevational view of the stuffed soft-sculptural creature of FIG. 4.
Figure 6:
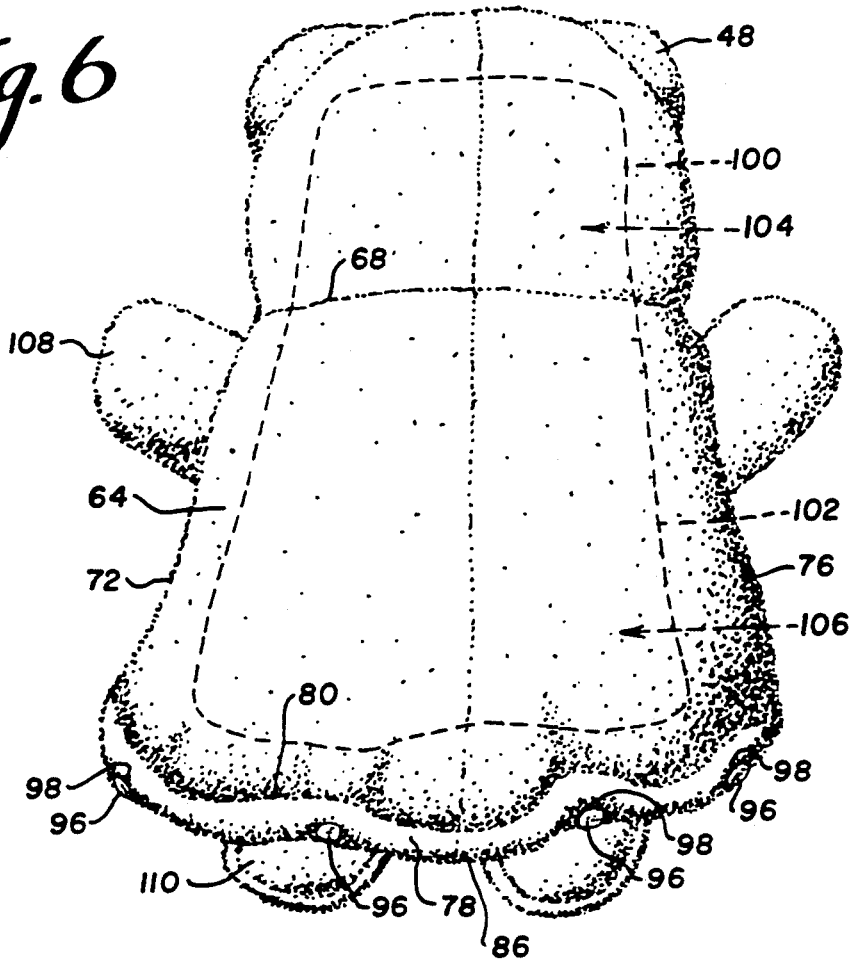
FIG. 6 is a rear elevational view thereof.

The combined soft sculpture and blanket 10 includes a soft-sculptural creature 12 attached to a blanket 14.

The term "creature" is used herein generically to denote the depiction of an animal, whether real or fantastic or other typical subject matter of plush toys used by children and others as decorative, doll-like and/or cuddle objects, whether the depicted object is a simulated real one, or a partly or wholly fantastic one, a cartoon character, an anthropomorphic fruit or vegetable, food (such as a candy kiss, or a cookie), or a packaged consumer product, such as a box of laundry detergent, all simulated in whole or in part by plush fabric, or the like, with applied graphics, or the like.

The term "blanket" is used herein generically to include any covering of the blanket type, whether it is one that most people would specifically call by the name blanket, or by an at least partly analogous term such as quilt, comforter, coverlet, lap robe, afghan, bedsheet, bedspread, futon, duvet, sleeping bag, or the like.

The blanket 14 is shown being generally rectangular, with a front surface 16, a rear surface 18, and an outer perimeter 20, including a left edge 22, a right edge 24, an upper edge 26 and a lower edge 28. These terms are used in their usual sense, from the perspective of a person using the blanket. No specific limitations not apparently essential are thereby intended. The blanket 14 is shown having a filling of conventional batting 30 and its front surface is shown having a design 32 of applied graphics, e.g. printed fabric.

The soft-sculptural creature 12 is shown exemplified by a polar bear including a head 34 and a torso 36.

The head, by preference, is made of a first, front layer 38 of plush fabric and a second, rear layer 40 of plush fabric, which are superimposed and secured together about their respective.. outer peripheries, e.g. by stitching 42, except at a location, adjoining the torso, where throughout a minor part of the peripheries, the two layers remain unattached so as to provide a neck opening 44 into the interior 46 of the back half of the head.

By preference, the front half of the head 34 is externally provided with creature-simulation features such as sewn-on plush ears 48, a muzzle 50 with a nose 52, eye buttons 54 and a mouth with a pink flannel interior and a flappable lower jaw. Although all of these features, with the exception of the conventional eye buttons are preferably made of the types of fabric conventionally used in the manufacture of plush toys and dolls, any of them may be made partly or wholly of synthetic plastic molded parts, e.g. the muzzle/mouth/jaw structure, as is conventional in the construction of some plush toys.

The front half of the head 34 is shown further including a stuffing 56 of conventional material such as polyester fleece (pillow stuffing), cotton linters, shredded soft foamed plastic resin (pillow stuffing) or the like such as is conventionally used for stuffing toys and pillows. This stuffing 56 fleshes out the face 58 of the creature so as to make it appear three-dimensional, including its muzzle and the curve of its face, in the preferred embodiment. The stuffing 56 is held in place by a partition wall 60, e.g. made of textile fabric, which has its entire outer peripheral margin sewn to or otherwise attached to the outer peripheral margin of the front layer 38 of the head 34.

Accordingly, in the preferred embodiment, regardless of whether the blanket 14 is stowed inside the soft-sculptural creature, or is spread outside for use, the front half of the creature's head remains stuffed and that stuffing is directly inaccessible to the person using the article 10.

The seam which sews the outer margin of the partition wall 60 to the outer margin of the front layer 38 of the head 34 may be the same seam which sews the outer margin of the front layer 38 to the outer margin of the rear layer 40. Although the front and rear layers are not sewn together across the neck, the front layer and partition wall preferably are sewn together in that region, so that within the creature 12, the actual opening into the cavity 46 provided in the rear half of the head 34 is defined between the partition wall 60 and the rear layer 40. Externally of the creature, and in a general sense, the opening into the head cavity is provided between the front and rear layers 38, 40 at the bottom of the head 34.

The back of the head 34 preferably is relatively undecorated so as not to interfere with a cuddling person and so that its appearance is relatively unaffected by whether the cavity 46 is stuffed, or not stuffed (both of which are alternatively the case in the different modes of use of the article 10 as will be further explained).

The torso 36 of the soft-sculptural creature 12 is shown including a front layer 62 and a rear layer 64. The layers 62 and 64 are preferably made of soft textile fabric such as acrylic plush, nylon plush, cotton plush, or the like (and in general out of any fabric conventionally used in making bodies of dolls, stuffed toys and upholstered furniture, and the like).

The layers 62 and 64 are shown superimposed, each preferably being generally blocky as seen straight-on, e.g. so as to have a generally rounded-corner rectangular outer perimeter. The respective upper edges 66, 68, left edges 70, 72 and right edges 74, 76 of the front and rear layers 62, 64 are cut so as to be able to be placed generally in registry, in the front-to-rear direction, although one of the panels 62, 64 (preferably the front panel 62) is longer so that not only do its left and right edges extend further from its top edge than do the corresponding edges of the rear panel 64, but the lower edge 78 of the front panel is located further from the top edge 66 than is the lower edge 80 of the rear panel 64 from the top edge 68.

The front panel 38 of the head 34 is shown sewn along its lower margin (i.e. perimetrically of the front half of the neck opening 44) to the upper margin 66 of the front panel 62 of the torso, these two edges preferably being of at least generally equal breadth. Likewise, the rear panel 40 of the head 34 is shown sewn along its lower margin (i.e. perimetrically of the rear half of the neck opening 44) to the upper margin 68 of the rear panel 64 of the torso, these two edges preferably being of at least generally equal breadth. The panels 38, 40 thus depend from the head 34 by means of the seams just described.

The soft-sculptural creature 12 is joined to the blanket 14, preferably permanently, preferably by sewing. By preference, this is accomplished by holding the front and rear panels 62, 64 of the torso 36 apart from below, inserting the top edge 26 of the blanket 14 between them, and advancing the edge of the blanket relatively upwards until the neckline 44 is at least generally coincident with the upper edge 26 of the blanket. In this condition, the front panel 62 of the torso drapes down over the front surface 16 of the blanket and the rear panel 64 of the torso drapes down over the rear surface 18 of the blanket. In this state, the front panel 62 is attached, e.g. by sewing, to the blanket 14, e.g. by a row of stitching 82 which extends in a rounded-corner rectangular shape bounding the left edge, top edge and right edge of the front panel 62, and which crosses the front panel at 84 in a left-right sense at approximately the same level as the lower edge 80 of the rear panel. Accordingly, a lower part of the front panel, i.e. from the portion 84 of the row of stitching 82, to the lower edge 78 is connected to the blanket 14 only by the stitching 82 and so depends from the stitching portion 84 as a lower flap 86 of the front panel 62.

The facing surfaces of the left margins of the front and rear panels are provided with cooperable unfastenable fastener means 88, 90. (Strips of Velcro® hook and fleece fastener material is shown, and preferred, but zippers, hooks and eyes, buttons and buttonholes, tacky adhesive strips and the like could be used.) The facing surfaces of the right margins of the front and rear panels are shown likewise provided with cooperable unfastenable fastener means 92, 94, as are the lower margins of the front and rear layers (although in the latter instance, the fasteners preferably are constituted by rows of buttons and corresponding button holes 96, 98).

In the preferred embodiment which is illustrated, the soft-sculptural creature 12 is substantially narrower, in a left to right sense, than is the blanket 14. And rather than being centered on the imaginary centerline which bifurcates the blanket 14 into left and right halves, or being disposed with one of its lateral extremes coincident with a corner or side edge of the blanket 14, the soft-sculptural creature is disposed part way, e.g. midway between those locations. The reason for this preference should be apparent from looking at FIG. 1. It permits a person to be covered by the blanket 14, with about as much of them sticking out from under the top edge as the soft-sculptural creature 12 protrudes in the same direction, with the blanket 14 centered in a left-to-right sense on a bed, or equivalent sleep surface, and for the person to be able to put an arm, or arms around the neck of the soft-sculptural creature, in a natural way, as if the person and the soft-sculptural creature were sleeping side-by-side in a bed.

When the blanket 14 is being used as a covering, none of the fasteners 88–98 are in a fastened condition and the rear layer 64 of the torso may either hang down against the underside 18 of the blanket 14, or, preferably, it may be rolled, folded or wadded-up and stuffed into the head cavity 46, so that even in this disposition, both the front and back of the head 34 are plumped-out and apparently stuffed.

When the blanket 14 is not being used, and a desire exists to convert the article 10 into a closer simulation of a stuffed plush toy or soft-sculptural object, the rear layer 64 of the torso is unstuffed from the head cavity 46 (if that is where it is), and the blanket is rolled, folded and/or wadded-up, e.g. until its perimeter lies within the imaginary boundary line 100 (which generally matches the size, shape and orientation of a combination of the head cavity 46, and a torso cavity 102 defined between the front and rear panels 62, 64 above the lower flap 86). Then, the upper part 104 of the folded blanket is stuffed into the head cavity 46, the lower part 106 is confined in the cavity 102 between the front and rear panels 62, 64, the flap 86 is wrapped under the lower part 106 of the folded blanket to constitute a bottom for the soft-sculptural creature, and the sets of fasteners 88 and 90, 92 and 94, and 96 and 98 are fastened respectively at the left, the right and the bottom-rear of the soft-sculptural creature, substantially completely enclosing the blanket 14 and simultaneously providing a stuffing for the soft-sculptural object.

Depending on the type of creature which the object 12 may depict, various appendages may be attached to respectively visually-appropriate sites on the various panels of the head and/or torso of the object 12 Such appendages may simulate, e.g. tentacles, legs/feet, arms (or forelegs)/hands (or paws), tails, antennae, horns, antlers, warts, armor plates, fins, pseudopods, tongues, ganglia and the like. In the instance depicted, these appendages are made of stuffed plush fabric and include arms (or forelegs) 108 attached by one-ends to the front panel, e.g. near the left and right margins of the front panel, but inwards of the respective fasteners sufficiently so as to avoid interference therewith, and legs 110 attached by one-ends to the front panels above the flap 86, e.g. along the sewing line which defines the upper edge of the flap panel. The arms and legs thus are positioned to remain outside the cavity, and visible at the front, regardless of whether the blanket is spread out, or is folded into the joint cavity 46, 102 and the fasteners 88–98 closed. It should be noticed that the front of the torso remains the front regardless of which of these two dispositions the blanket is in, so that paws, feet, hooves, etc. 112 provided near the free outer ends of the appendages 108, 110 can have a natural look (rather than needing to be stubs as would be the case for a torso which reversed roles from front to back as the blanket changed dispositions).

The inner surfaces of the back panel of the torso and of the flap 86, which are subject to being seen when the blanket is in its outer disposition may be lined, e.g. with a decorative lining fabric 114, which may also conceal a thin stuffing layer, e.g. of batting.

It would not depart from the principles of the invention to provide the blanket with one or more appendages which protruded out of the body cavity when the blanket was otherwise substantially completely enclosed in the body cavity It should now be apparent that the combined soft sculpture and blanket as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A combined soft sculpture and blanket, comprising:

a blanket having a front surface, a back surface and an outer perimeter including an edge; and a soft-sculptural object including a head portion connected with a torso portion at a neck having a perimeter;

said torso portion including a front panel made of flexible fabric and a back panel made of flexible fabric; each of said panels having a top edge, a left edge, a right edge and a bottom edge;

said top edges of said front and back panels being secured to said head along complementary portions of the perimeter of said neck;

one of said panels being substantially longer than the other so that each of said panels has a corresponding main portion, but the longer one of them in addition has a lower flap portion;

one of said panels being disposed facewise against one of said surfaces of said blanket with the top edge of such panel adjacent and extending along said edge of said blanket, with said head portion protruding beyond said outer perimeter of said blanket at said edge;

means securing the main portion of the last-mentioned said panel, perimetrically thereof to said blanket;

complementary securement means provided on said main portions of said panels along left edges of said panels;

complementary securement means provided on said main portions of said panels along right edges of said panels; and complementary securement means provided on said lower flap portion of said longer one of said panels along the bottom edge thereof, and on the main portion of the other of said panels along the bottom edge thereof;

said combined soft sculpture and blanket having:

a first disposition in which said complementary securement means are unsecured and said blanket is spread-out, and a second disposition in which said blanket is condensed by at least one of folding, rolling and wadding up, and said complementary securement means are secured with said condensed blanket being substantially completely enclosed within said soft-sculptural object.

2. The combined soft sculpture and blanket of claim 1, wherein:

said edge of said perimeter of said blanket has two laterally opposite ends and said soft-sculptural object is disposed intermediate an imaginary longitudinally centerline of said blanket and one of said ends, so as to be laterally spaced from both said one end and said imaginary longitudinal centerline.

3. The combined soft sculpture and blanket of claim 2, wherein:

said blanket is a quilt having a filling between said front and back surfaces, and having a graphic design applied on said front surface.

4. The combined soft sculpture and blanket of claim 2, wherein:

said head portion is at least partly hollow so as to have an open internal cavity which communicates through said neck with said torso portion between said front and back panels; and in said second disposition of said blanket, part of said blanket is received within said cavity of said head portion.

5. The combined soft sculpture and blanket of claim 4, wherein:

said head portion comprises a front panel perimetrically attached to a rear panel except across said neck.

6. The combined soft sculpture and blanket of claim 5, wherein:

said front and rear panels of said head portion are made of flexible fabric.

7. The combined soft sculpture and blanket of claim 6, wherein:

said flexible fabric of said head portion and said torso portion are made at least predominantly of textile fabric.

8. The combined soft sculpture and blanket of claim 7, wherein:

said textile fabric is a plush pile fabric.

9. The combined soft sculpture and blanket of claim 4, further including:

a partition wall received within said head portion and extending therein and being secured thereto so as to isolate a closed front half cavity of said head portion from an open rear half cavity, which communicates through said neck with said torso portion between said front and back panels of said torso portion.

10. The combined soft sculpture and blanket of claim 9, further comprising:

a creature face simulation applied to said head portion so as to be visible externally of said soft-sculptural object, said closed front half cavity of said head portion containing a filling stuffing material.

11. The combined soft sculpture and blanket of claim 10, wherein:

said creature face simulation includes a muzzle and said filling of stuffing material is received within said muzzle from behind so as to add a three-dimensional quality to said soft-sculptural object.

12. The combined soft sculpture and blanket of claim 4, wherein:

the one of said panels which is disposed on said one surface of said blanket and has said main portion attached to said blanket is said front panel of said torso portion; and in said first disposition of said combined soft sculpture and blanket, said back panel of said torso portion is condensed and stowed in said open cavity of said head portion.

13. The combined soft sculpture and blanket of claim 12, wherein:

said head portion comprises a front panel perimetrically attached to a rear panel except across said neck;

said front and back panels of said head portion are made of flexible fabric.

said flexible fabric of said head portion and said torso portion are made at least predominantly of textile fabric.

14. The combined soft sculpture and blanket of claim 13, a partition wall received within said head portion and extending therein and being secured thereto so as to isolate a closed front half cavity of said head portion from an open rear half cavity, which communicates through said neck with said torso portion between said front and back panels of said torso portion.

15. The combined soft sculpture and blanket of claim 14, a creature face simulation applied to said head portion so as to be visible externally of said soft-sculptural object, said closed front half cavity of said head portion containing a filling stuffing material.

16. The combined soft sculpture and blanket of claim 15, wherein:

said creature face simulation includes a muzzle and said filling of stuffing material is received within said muzzle from behind so as to add a three-dimensional quality to said soft-sculptural object.

17. The combined soft sculpture and blanket of claim 1, wherein:

in said second disposition of said combined soft sculpture and said blanket, part of said blanket is received within said internal cavity of said head portion.

18. The combined soft sculpture and blanket of claim 17, wherein:

said head portion comprises a front panel perimetrically attached to a rear panel except across said neck;

said front and back panels of said head portion are made of flexible fabric; and said flexible fabric of said head portion and said torso portion are made at least predominantly of textile fabric.

19. The combined soft sculpture and blanket of claim 18, a partition wall received within said head portion and extending therein and being secured thereto so as to isolate a closed front half cavity of said head portion from an open rear half cavity, which communicates through said neck with said torso portion between said front and back panels of said torso portion.

20. The combined soft sculpture and blanket of claim 19, further including:

a creature face simulation applied to said head portion so as to be visible externally of said soft-sculptural object, said closed front half cavity of said head portion containing a filling stuffing material.

21. The combined soft sculpture and blanket of claim 20, wherein:

said creature face simulation includes a muzzle and said filling of stuffing material is received within said muzzle from behind so as to add a three-dimensional quality to said soft-sculptural object.

22. The combined soft sculpture and blanket of claim 21, wherein:

said edge of said perimeter of said blanket has two laterally opposite ends and said soft-sculptural object is disposed intermediate an imaginary longitudinally center line of said blanket and one of said ends, so as to be laterally spaced from both said one end and said imaginary longitudinal centerline.

23. The combined soft sculpture and blanket of claim 22, wherein:

the one of said panels which is disposed on said one surface of said blanket and has said main portion attached to said blanket is said front panel of said torso portion; and in said first disposition of said combined soft sculpture and blanket, said back panel of said torso portion is condensed and stowed in said open cavity of said head portion.

24. The combined soft sculpture and blanket of claim 17, wherein:

the one of said panels which is disposed on said one surface of said blanket and has said main portion attached to said blanket is said front panel of said torso portion; and in said first disposition of said combined soft sculpture and blanket, said back panel of said torso portion is condensed and stowed in said open cavity of said head portion.

25. The combined soft sculpture and blanket of claim 1, wherein:

the one of said panels which is disposed on said one face of said blanket and has said main portion attached to said blanket is said front panel of said torso portion.

26. The combined soft sculpture and blanket of claim 25, wherein:

the first-mentioned and second-mentioned ones of said complementary securement means are provided by complementary strips of hook and fleece fasteners.

27. The combined soft sculpture and blanket of claim 25, wherein:

in said second disposition of said combined soft sculpture and blanket, said lower flap portion extends generally horizontally in a front-to-rear direction and provides a support base on which the soft-sculptural object may be stood upright.

28. The combined soft sculpture and blanket of claim 27, wherein:

the first-mentioned and second-mentioned ones of said complementary securement means are provided by complementary strips of hook and fleece fasteners.

29. The combined soft sculpture and blanket of claim 27, wherein:

said edge of said perimeter of said blanket has two laterally opposite ends and said soft-sculptural object is disposed intermediate an imaginary longitudinally center line of said blanket and one of said ends, so as to be laterally spaced from both said one end and said imaginary longitudinal centerline.

30. The combined soft sculpture and blanket of claim 27, wherein:

said head portion is at least partly hollow so as to have an open internal cavity which communicates through said neck with said torso portion between said front and back panels; and in said second disposition of said blanket, part of said blanket is received within said cavity of said head portion.

31. The combined soft sculpture and blanket of claim 30, wherein:

said head portion comprises a front panel perimetrically attached to a rear panel except across said neck;

said front and back panels of said head portion are made of flexible fabric;

said flexible fabric of said head portion and said torso portion are made at least predominantly of textile fabric.

32. The combined soft sculpture and blanket of claim 31, wherein:

said soft-sculptural object depicts a creature and said soft sculptural object further includes at least one elongated appendage attached by an end thereof to one of said panels.

33. The combined soft sculpture and blanket of claim 32, wherein:

said at least one appendage comprises a pair of arms or forelegs attached to said front panel of said torso portion at laterally spaced sites.

34. The combined soft sculpture and blanket of claim 33, wherein:

said at least one appendage further comprises a pair of legs attached to said front panel of said torso portion at laterally spaced sites.

35. The combined soft sculpture and blanket of claim 34, wherein:

said arms or forelegs and said legs are made of stuffed textile fabric.

36. The combined soft sculpture and blanket of claim 35, wherein:

said textile fabric is a plush pile fabric.

37. The combined soft sculpture and blanket of claim 36, wherein:

said edge of said perimeter of said blanket has two laterally opposite ends and said soft-sculptural object is disposed intermediate an imaginary longitudinally centerline of said blanket and one of said ends, so as to be laterally spaced from both said one end and said imaginary longitudinal centerline.

38. A combined soft sculpture and blanket, comprising:

a blanket having a front surface, a back surface and an outer perimeter including an edge; and a soft-sculptural object including a head portion connected with a torso portion at a neck having a perimeter;

said torso portion including a front panel made of flexible fabric and a back panel made of flexible fabric; each of said panels having a top edge, a left edge, a right edge and a bottom edge;

said top edges of said front and back panels being secured to said head along complementary portions of the perimeter of said neck;

one of said panels being disposed facewise against one of said surfaces of said blanket with the top edge of such panel adjacent and extending along said edge of said blanket, with said head portion protruding beyond said outer perimeter of said blanket at said edge;

means securing the last-mentioned said panel about a major portion of the outer perimeter thereof to said blanket;

complementary securement means provided on said panels along left edges thereof;

complementary securement means provided on said panels along right edges of said panels; and complementary securement means provided on said panels along bottom edges thereof;

said combined soft sculpture and blanket having:

a first disposition in which said complementary securement means are unsecured and said blanket is spread-out, and a second disposition in which said blanket is condensed by at least one of folding, rolling and wadding up, and said complementary securement means are secured with said condensed blanket being substantially completely enclosed within said soft-sculptural object;

said edge of said perimeter of said blanket has two laterally opposite ends and said soft-sculptural object is disposed intermediate an imaginary longitudinally centerline of said blanket and one of said ends, so as to be laterally spaced from both said one end and said imaginary longitudinal centerline.

39. The combined soft sculpture and blanket of claim 38, wherein:

said head portion is at least partly hollow so as to have an open internal cavity which communicates through said neck with said torso portion between said front and back panels; and in said second disposition of said blanket, part of said blanket is received within said cavity of said head portion;

said head portion comprises a front panel perimetrically attached to a rear panel except across said neck;

said front and back panels of said head portion are made of flexible fabric;

said flexible fabric of said head portion and said torso portion are made at least predominantly of textile fabric;

a partition wall received within said head portion and extending therein and being secured thereto so as to isolate a closed front half cavity of said head portion from an open rear half cavity, which communicates through said neck with said torso portion between said front and back panels of said torso portion;

a creature face simulation applied to said head portion so as to be visible externally of said soft-sculptural object, said closed front half cavity of said head portion containing a filling of stuffing material;

said creature face simulation includes a muzzle and said filling of stuffing material is received within said muzzle from behind so as to add a three-dimensional quality to said soft-sculptural object;

the one of said panels which is disposed on said one surface of said blanket and is attached to said blanket about a major portion of the perimeter thereof is said front panel of said torso portion; and in said first disposition of said combined soft sculpture and blanket, said back panel of said torso portion is condensed and stowed in said open cavity of said head portion.

40. The combined soft sculpture and blanket of claim 39, wherein:

the first-mentioned and second-mentioned ones of said complementary securement means are provided by complementary strips of hook and fleece fasteners.

41. The combined soft sculpture and blanket of claim 40, wherein:

said soft-sculptural object depicts a creature and said soft sculptural object further includes at least one elongated appendage attached by an end thereof to one of said panels.

42. The combined soft sculpture and blanket of claim 41, wherein:

said at least one appendage comprises a pair of arms or forelegs attached to said front panel of said torso portion at laterally spaced sites;

said at least one appendage further comprises a pair of legs attached to said front panel of said torso portion at laterally spaced sites; and said arms or forelegs and said legs are made of stuffed textile fabric.

* * * * *